US005685041A

United States Patent [19]

Sivacoe

[11] Patent Number: 5,685,041

[45] Date of Patent: Nov. 11, 1997

[54] PIPE PIG WITH ABRASIVE EXTERIOR

[76] Inventor: Orlande Sivacoe, #601, 4700 - 55 Street, Red Deer, Alberta, Canada, T4N 2H8

[21] Appl. No.: 601,095

[22] Filed: Feb. 14, 1996

[51] Int. Cl.[6] ..... B08B 9/04

[52] U.S. Cl. ..... 15/104.061

[58] Field of Search ..... 15/3.5, 3.51, 104.061

[56] References Cited

U.S. PATENT DOCUMENTS

| | | | |
|---|---|---|---|
| 3,204,274 | 9/1965 | Knapp | 15/104.061 |
| 3,725,968 | 4/1973 | Knapp et al. | 15/104.061 |
| 3,939,519 | 2/1976 | Muirhead | 15/104.061 |
| 4,383,346 | 5/1983 | Bochinsici et al. | 15/104.061 |
| 5,457,841 | 10/1995 | Minton | 15/104.061 |
| 5,567,392 | 10/1996 | Becker et al. | 422/174 |

FOREIGN PATENT DOCUMENTS

| | | | |
|---|---|---|---|
| 53355 | 6/1982 | European Pat. Off. | 15/3.5 |
| 3130679 | 2/1983 | Germany | 15/104.061 |
| 956348 | 9/1982 | U.S.S.R. | 15/104.061 |

*Primary Examiner*—Mark Spisich

*Attorney, Agent, or Firm*—Frank J. Dykas

[57] ABSTRACT

A method of making a rotationally symmetric pipe pig in which porous abrasive material is adhered to the periphery of the pipe pig. A liquid applied surface layer of the pig body forms an adhesive for the porous abrasive material, which is cured after the application of the porous abrasive material. A porous abrasive material is alumina ceramic beads. The pipe pig thus formed has a porous abrasive material adhered to the periphery of the pipe pig.

4 Claims, 1 Drawing Sheet

PIPE PIG WITH ABRASIVE EXTERIOR

FIELD OF THE INVENTION

This invention relates to pipe pigs, and a method of making pipe pigs.

BACKGROUND AND SUMMARY OF THE INVENTION

Pipe pigs are used to remove coatings or scale from the inside of pipes. This coating can vary in thickness and hardness. For example, deposits of coke can form soft coatings several millimeters thick, while hard scale such as iron sulphide may form coatings less than 1 mm thick. Pipe pigs are forced through the pipes under hydraulic pressure and the coating is removed by the scraping action of the pigs. To improve the scraping action, such pigs may include hard appendages that scrape the coating. These appendages are subject to wear, and can be expensive and inconvenient to replace.

The inventor has previously provided a pipe pig with detachable appendages for use with a generally cylindrical or spherical foam pipe pig, as described in U.S. Pat. No. 5,265,302 of Orlande Sivacoe to overcome problems associated with the appendages wearing out. Such pigs are particularly useful in removing hard scale.

Pigs are also known that have abrasive material, such as sand, glass, diamond dust, silicon carbides, etc, on the surface of the pig, as for example described in U.S. Pat. No. 4,016,620 of Marvin D. Powers. In addition, the inventor has for several years used pigs with abrasive distributed within them that enhances the scraping action of the pigs.

One difficulty with making foam pigs having abrasive distributed within the foam pig is that much of the abrasive remains deep within the foam pig and does not provide a useful scraping action. Yet the inventor has found that using an adhesive to coat abrasive material on the surface of the pig does not secure the abrasive material on the pig sufficiently to allow the pig to clean a large amount of pipe.

One solution to this difficulty is presented in U.S. patent application Ser. No. 08/403,247, abandoned, in which there is provided a method of making a rotationally symmetric pipe pig in which abrasive material is distributed to the periphery of the pipe pig by centrifuging the pipe pig. Preferably, the pipe pig is cylindrical with a central axis and the pipe pig is centrifuged about its central axis. Preferably the abrasive is a particulate material. Such a pipe pig may also include a plurality of appendages disposed about and extending radially outward from the body of the pig. The combined cleaning function of the appendages and abrasive provides an efficient cleaning function. While this design works to some extent, after several runs the foam tends to wear away, taking with it the abrasive material.

The invention presented here provides an improved method of coating a pipe pig with abrasive, and an improved resulting pipe pig.

In accordance with one aspect of the invention, there is provided a pipe pig comprising:

- a pig body having an axis of rotational symmetry and a periphery, and being made of resilient material; and
- porous abrasive material adhered to and surrounding the periphery of the pig body.

The porous nature of the abrasive material allows adhesive to invade the abrasive material and securely adhere the abrasive material to the pig body.

The abrasive material is preferably formed of particulate alumina ceramic beads. The pig body preferably includes a core and a surface layer, the surface layer having a greater hardness than the core, with the surface layer forming an adhesive for adhering the abrasive material to the pig body.

In accordance with a further aspect of the invention, there is provided a method of making a pipe pig, the method comprising the steps of:

- forming a generally cylindrical pig body having a periphery; and
- adhering porous abrasive material to the periphery of the pig body.

Preferably, adhering porous abrasive material to the periphery of the pig body includes:

- applying the porous abrasive material to a liquid applied elastomeric surface layer of the pig body and subsequently curing the liquid applied elastomeric surface layer to adhere the porous abrasive material to the pig body.

And, in a further aspect of the invention, forming a generally cylindrical pig body includes:

- liquid applying the elastomeric surface layer onto a core, the liquid applied elastomeric surface laying being harder, when cured, than the core.

There will now be described a preferred embodiment of the invention, with reference to the figure, which shows a longitudinal section of a pipe pig according to the invention.

DETAILED DESCRIPTION OF PREFERRED EMBODIMENTS

Figure 1:
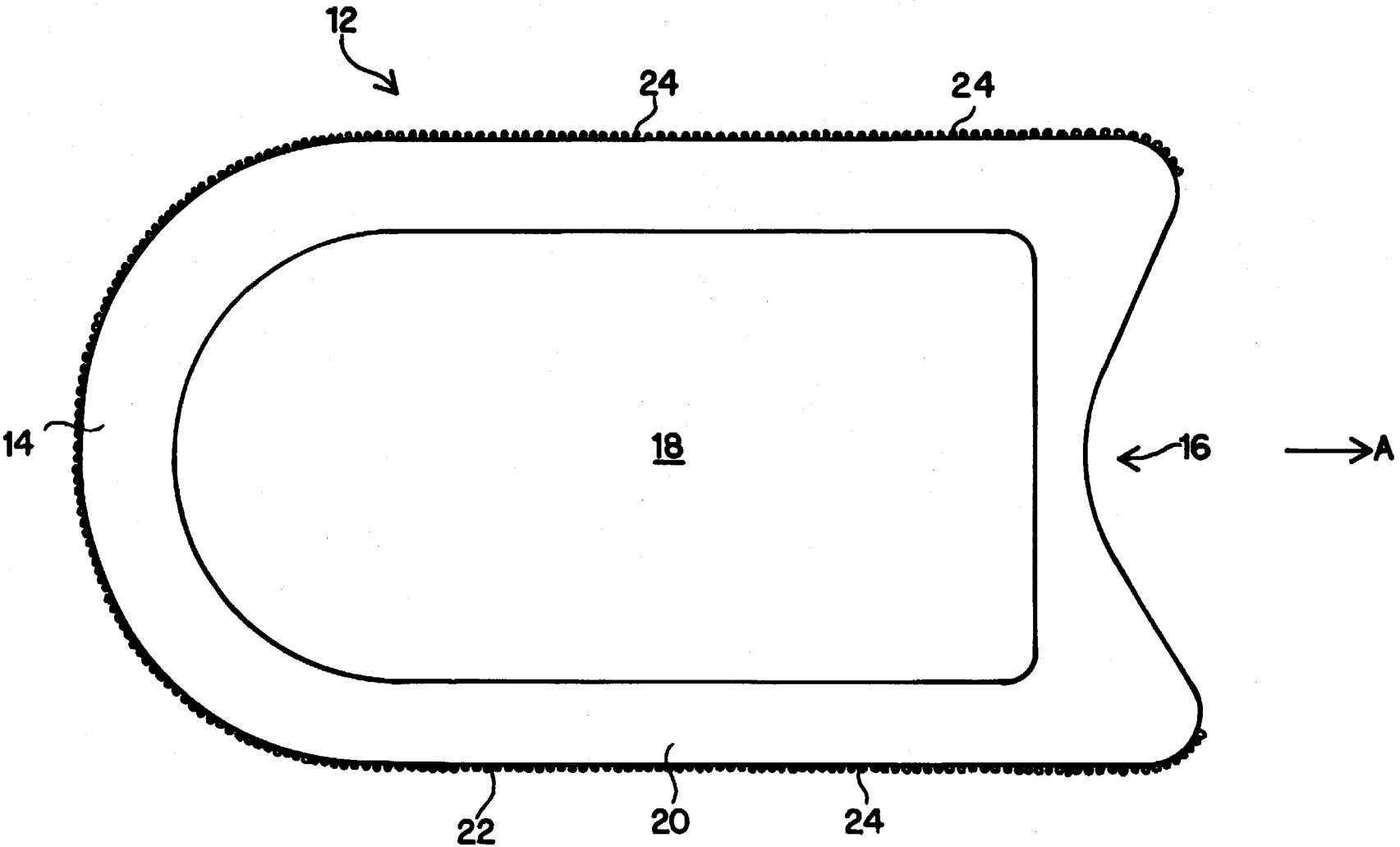

Referring to the figure, there is shown a generally cylindrical pig 12 made of resilient material. The body of the pig may be bullet shaped as shown, cylindrical with conical ends, and other shapes for example oval with varying degrees of elongation. It is believed necessary only that the pig have an axis of rotational symmetry (for example the axis A shown in the figure), not that it be exactly cylindrical. Such an axis is provided by the axis of a cylinder in the case of a cylindrical pig.

The pig 12 includes a nose 14 at one end and has a conical recess 16 at the other end. The core 18 of the pig 12 is made from polyurethane foam in conventional fashion. The core 18 is surrounded by an approximately 1.2 cm thick surface layer 20 made of a polyurethane elastomer mixed to obtain a 85–90 durometer hardness upon curing, harder than the foam core. Such an elastomer can be obtained from any of various suppliers of polyurethane. The surface layer 20 has an outer boundary 22 forming the periphery of the pig body, and a porous abrasive material or scraping medium 24, such as alumina ceramic bead (mullite, CAS no. 1302-76-7) available from Coors Wear Products, Industrial Ceramics, of Lawrence, Philadelphia U.S.A., is adhered to the periphery 22 of the pig body.

A bead is sufficiently porous to be suited for use in the present invention if it is visibly porous to the eye assisted by a 20 power magnifying instrument. The porosity should be such that the adhesive will finger into the pores of the abrasive material and bind the abrasive material so that it can withstand cleaning runs in a pipe contaminated with hard scale (coke) in which the total run length is at least 5 km length before being eroded off the pig body. The porous abrasive material 24 should surround the pig body 12 such that when the pipe pig moves through a pipe, substantially all of the interior diameter of the pipe will see some scraping action. That is, any longitudinal straight line lying on the surface of the pig body and extending from one end of the pig to another should intersect porous abrasive material. While it is not necessary that all of the periphery 22 of the pig body 12 be coated with porous abrasive material, it is preferred. The porous abrasive material 24 may for example be applied in a pattern, such as a spiral. For ease of application, a random pattern is acceptable. It is preferred that the abrasive material be a particulate, such as a bead. The size and hardness of the bead should be selected for the intended application. A high hardness in the range of 7–9 on Mohs scale is preferred for hard scale. The size of the bead may also be selected for the intended purpose, and the particles on a given pig may vary in size, for example particle diameters from 1 mm to 3 mm has been found suitable. A suitable mesh size would be −8 to +14, with 90% of the particles falling within this size range.

It is preferred that the elastomer be as hard as possible to securely adhere the abrasive material to the pig body, subject to the constraint that the pig body must remain sufficiently elastic and resilient for its intended application.

The manner of making the pig 12 is as follows. The core 18 is made by injection of elastomer into a mould having the desired shape. The core 18 is then spun in conventional fashion and the surface layer applied in liquid form with a spatula while the core 18 is spinning. Heat is applied by lamps to the polyurethane elastomer to dry and cure it quickly. When a sufficiently thick polyurethane elastomer surface layer has been applied, the beads are spread on the still soft surface of the pig 12 with a spatula before the surface layer has dried. As much abrasive material as can be adhered to the pig body is preferably be applied so that the pig body is entirely coated with abrasive material. The elastomer invades the pores of the ceramic beads and holds them in place, thus functioning as an adhesive for the porous abrasive material. The resulting pig has been found to be capable of cleaning about 24 km of pipe before the beads were worn to the point of no longer functioning, while a pig with non-porous silica carbide adhered to the pig body in much the same manner was only able to clean about 2 km of pipe before being worn off.

Preferably, the pipe pig with abrasive exterior is run in conjunction with a pig having appendages, such as described in U.S. Pat. No. 5,265,302, with the appendages used initially to break up the scale in the pipe and the present pipe pig run afterward to remove the remaining scale down to the metal of the pipe.

While it is possible to use centrifuging to force the abrasive material to the periphery of the pig body, this is not preferred as this tends to leave too much of the abrasive inside the pig body where it has no scraping effect.

A person skilled in the art could make immaterial modifications to the invention described and claimed in this patent without departing from the essence of the invention.

The embodiments of the invention in which an exclusive property or privilege is claimed are as follows:

1. A pipe pig comprising:

(a) an elongated resilient pig body having an axis of symmetry along the length thereof, said pig body having a nose at a first end thereof, said pig body further comprising a core and a surface layer, said surface layer completely covering said core, the surface layer also having a hardness greater than that of said core, the material of said surface layer having an adhesive property; and (b) a porous particulate abrasive material adhesively adhered to said pig body by said surface layer, said abrasive material covering substantially the entire periphery of said pig body, the porous nature of said particulate abrasive material allowing the material of said surface layer to finger into the pores thereof whereby a strong bond is formed between the abrasive particulate material and the surface layer of said pig body.

2. The pipe pig of claim 1 wherein said core which is made of polyurethane.

3. The pipe pig of claim 1 in which said porous particulate abrasive material is alumina ceramic.

4. The pipe pig of claim 1 further comprising:

said core being made of polyurethane; and the porous particulate abrasive material being alumina ceramic.

* * * * *